US005146437A

United States Patent [19]

Boucheron

[11] Patent Number: 5,146,437

[45] Date of Patent: Sep. 8, 1992

[54] WATCH WITH REMOVABLE BRACELET

[75] Inventor: Alain Boucheron, Paris, France

[73] Assignee: Boucheron, Paris, France

[21] Appl. No.: 772,370

[22] PCT Filed: Mar. 13, 1991

[86] PCT No.: PCT/FR91/00204

§ 371 Date: Nov. 5, 1991

§ 102(e) Date: Nov. 5, 1991

[87] PCT Pub. No.: WO91/14212

PCT Pub. Date: Sep. 19, 1991

[30] Foreign Application Priority Data

Mar. 14, 1990 [FR] France ..... 90 03277

[51] Int. Cl.[5] ..... G04B 37/00; A44C 5/14

[52] U.S. Cl. ..... 368/282; 224/167

[58] Field of Search ..... 368/281-282, 368/276; 224/167, 168, 177

[56] References Cited

U.S. PATENT DOCUMENTS

| | | | |
|---|---|---|---|
| 1,775,174 | 9/1930 | Roy | 368/282 |
| 2,148,629 | 2/1939 | Levesque | 24/265 |
| 3,589,575 | 6/1971 | Axler | 224/4 E |
| 4,401,388 | 8/1983 | Mearns | 368/282 |
| 4,432,655 | 2/1984 | Wollman | 368/282 |
| 4,664,533 | 5/1987 | Wollman | 368/282 |

FOREIGN PATENT DOCUMENTS

| | | |
|---|---|---|
| 291881 | 3/1972 | Switzerland . |
| 408794 | 6/1980 | Switzerland . |

*Primary Examiner*—Vit W. Miska

*Attorney, Agent, or Firm*—Beveridge, DeGrandi & Weilacher

[57] ABSTRACT

A bracelet watch comprises a removable flexible bracelet (2), the ends (5) of which are reinforced by an elastic tubular blade (6) or a cylindrical jaw inserted into a sleeve (7) removably fitting into a drilling (13) made in one side (1a) of the case (1) of the watch. A pawl mechanism (11, 16) is fitted for this assembly system.

10 Claims, 2 Drawing Sheets

WATCH WITH REMOVABLE BRACELET

The present invention relates to a bracelet watch comprising a watch of which the case has at least two parallel opposite sides each provided with assembly means removably fitting into a metallic element reinforcing a free end of a flexible bracelet.

Bracelet watches of this type are known, in which the removable assembling of the bracelet and the watch makes it possible to fit different types of bracelets to a given watch. The interchangeability of the bracelets enhances the appearance of the bracelet watch and enables the user to vary the color, particularly, of the bracelet fitted to the watch.

In order to provide interchangeability of bracelets, the conventional technique consists in securing each free end of the bracelet to a metallic element in the form of a short rod provided with an axial depression in which the free end of the bracelet is folded into a loop around an assembly screw. The free end of the bracelet reemerges from the depression of the metallic short rod in order to be sewn on the non-exposed face of the bracelet.

The metallic short rod also has a longitudinal leaf on its outer face, provided with a protuberance at its free end which can be retracted into the short rod so as to be capable of providing a pawl link with a longitudinal groove made in a drilling on one side of the case of the watch.

The bracelet thus obtained has, in the vicinity of the metallic short rod at the end, an excess thickness due to the end loop for the assembly. This excess thickness may be uncomfortable on the wrist of the user. The metallic short rods are made from solid metal, for example solid gold, the manufacture and the fitting of which on an end of the bracelet are relatively complicated to achieve.

Moreover, the assembling of a metallic short rod and the watch prevents the free rotation of the short rod and thus of the bracelet inside the corresponding drilling of the watch, due to the design of the pawl means.

The object of the present invention is to remedy the abovementioned disadvantages by producing a watch with removable bracelet, the system of assembling the watch and the bracelet being designed in a simple and original manner.

The bracelet watch according to the invention comprises a watch of which the case has at least two parallel opposite sides in order seen each [sic] with an assembly means removably fitting into a rigid element reinforcing a free end of a flexible bracelet. The rigid element may be metallic and comprises an elastic tubular blade and a sleeve, one end of which is closed. The tubular blade has a toothed axial slot in which one free end of the flexible bracelet is inserted. The sleeve has an axial slot emerging at the open end of the sleeve and the opening of which is larger than the thickness of the bracelet in order to permit the passage of the latter. The internal diameter of the sleeve is smaller than the external diameter of the tubular blade, such that the axial insertion of the tubular blade into the sleeve requires an elastic deformation of the blade, giving rise to blocking of the free end of the bracelet by pinching of the toothed slot.

The elastic tubular blade may be replaced by a jaw of substantially cylindrical form, the opening of which is longitudinal. The two toothed elements of the jaw preferably form a single assembly and are connected to each other by means of a flexible longitudinal tab opposite the opening of the jaw. For assembly, one free end of the bracelet is inserted into the jaw via the longitudinal opening, the toothed elements making it possible to retain the end of the bracelet. The closed jaw is inserted axially in the sleeve in the same manner as the tubular blade.

The assembly means of the watch case comprises a drilling with a diameter which is substantially identical to that of the sleeve. The wall of the drilling has an axial slot passing through it, the opening of which is larger than the thickness of the bracelet in order to permit its passage when the sleeve is fitted into the drilling of the case.

The invention will be better understood from a study of the detailed description of two embodiments of the invention, taken by way of examples, which imply no limitation and are illustrated by the appended drawings, in which.

Figure 1:
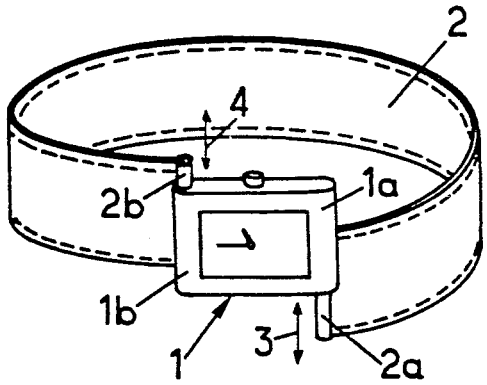
FIG. 1 is an overall view of a removable bracelet watch according to the invention.

As illustrated in FIG. 1, the bracelet watch according to the invention comprises a watch case 1 and a removable flexible bracelet 2, preferably made from leather. The case 1 has a substantially parallelepipedal form, two opposite and parallel sides 1*a* and 1*b* of which are rounded. The free ends of the bracelet 2 are reinforced by cylindrical rigid elements 2*a* and 2*b* each capable of removably fitting into a drilling made in the sides 1*a* and 1*b* of the case 1, in the direction of the arrows 3 and 4.

Preferably, respective openings for the two drillings of the case 1 are located diametrically opposite each other.

Figure 2:
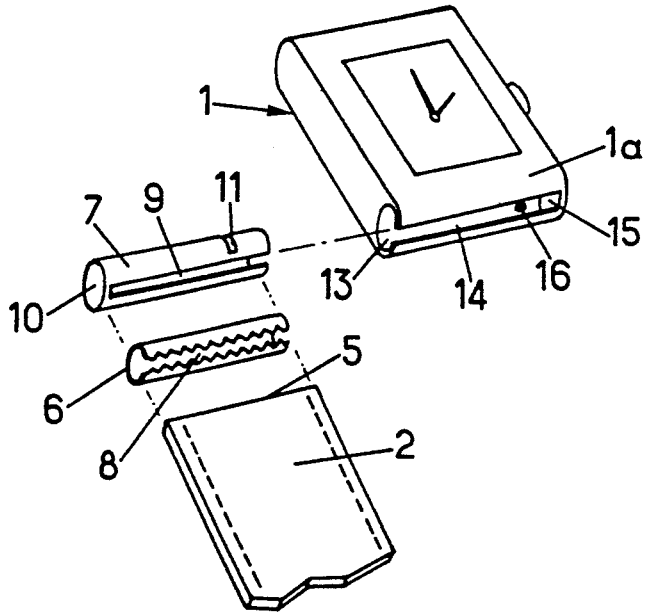
FIG. 2 is an exploded view of the assembly system of the invention.
Figure 3:
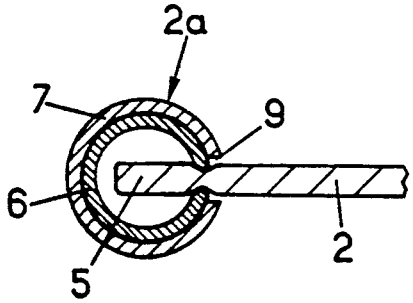
FIG. 3 is a sectional view along the bracelet in order to show the structure of the rigid element according to the first embodiment of the invention.

The bracelet 2 is made in the form of an elongated strap. FIGS. 2 and 3 show the manner in which the rigid element 2*a* is fitted to the corresponding end 5 of the bracelet 2. The rigid element 2*a* consists of an elastic tubular blade 6 and of a tubular sleeve 7. The tubular blade 6 comprises a toothed longitudinal slot 8 permitting, in the free state, the insertion of the free end 5 of the bracelet 2. The sleeve 7 has an axial slot 9, a closed end 10 and a circumferential groove 11. The opening of the axial slot 9 of the sleeve 7 is larger than the thickness of the free end 5 of the bracelet 2 in order to permit its passage.

The internal diameter of the sleeve 7 must be smaller than the external diameter of the elastic tubular blade 6 when it is in the free state. This requirement is necessary to impose an elastic deformation on the blade 6, which is reflected in a reduction in its cross-section upon its assembly inside the sleeve 7. This elastic deformation of the tubular blade 6 is reflected in a pinching of the toothed slot 8 on the two faces of the end part 5 of the bracelet 2, thus enabling the corresponding end part 5 to be held in the rigid element 2a.

Assembly of the rigid element 2a on the free end 5 of the bracelet 2 is relatively simple. Firstly, the free end 5 of the bracelet 2 is inserted into the toothed slot 8 of the elastic tubular blade 6. An elastic deformation is then imposed on the blade 6 in order to reduce its section by means of an external force. The tubular blade 6 with the end part 5 of the bracelet pinched in the toothed slot 8 is inserted axially inside the tubular sleeve 7 via its open end opposite the end 10. When fitting the tubular blade 6 in the sleeve 7, the end part 5 of the bracelet 2 slides in the axial slot 9 of the sleeve 7. The elastic deformation of the tubular blade 6 is then maintained by the inner wall of the sleeve 7, as shown in FIG. 3.

Once the rigid element 2a has been fitted on the free end 5 of the bracelet 2, it is possible to insert the rigid element 2a axially in the drilling 13 made on the corresponding side 1a of the case 1 of the watch. As with the sleeve 7, the wall of the drilling 13 has a longitudinal slot 14 passing through it on the side permitting the passage of the end part 5 of the bracelet 2. The drilling 13 ends in a bottom 15 integral with one side of the case 1. The bracelet 2, provided with the rigid element 2a, and the case 1 are then assembled by inserting the open end of the sleeve 7 in the opening of the drilling 13 of the case 1.

Figure 4:
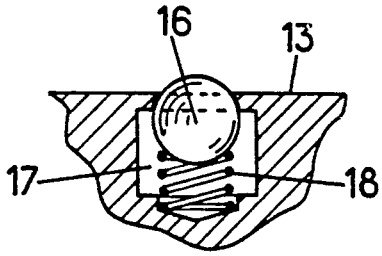
FIG. 4 is a partial sectional view of the pawl means fitted to the case to the watch according to the invention.

Moreover, the invention provides a pawl mechanism for the said assembling of the case 1 of the watch and the bracelet 2. This pawl mechanism consists, on the one hand, of the circumferential groove 11 of the sleeve 7 and, on the other hand, of a retractable protuberance 16 on the inner wall of the drilling 13. As shown in FIG. 4, the retractable protuberance 16 may consist of a ball located in a cavity 17 made in the inner wall of the drilling 13. A compression spring 18 inserted in the cavity 17 exerts a radial force, forcing the ball 16 towards the inside of the drilling 13, the position of the ball 16 on the inner wall of the drilling 13 being such that the circumferential groove 11 of the sleeve 7 is located opposite the ball in the assembled position of the bracelet 2 on the case 1.

During insertion of the sleeve 7 in the drilling 13, the ball 16 firstly encounters the open end of the sleeve 7 and the outer wall of the corresponding end part of the sleeve 7, which forces the ball 16 to enter towards the inside of the cavity 17 due to the slight play between the sleeve 7 and the drilling 13. The circumferential groove 11 of the sleeve 7 then encounters the ball 16 which, through the thrust of the spring 18, comes into contact with the bottom of the groove 11, thus forming a means blocking the axial movement of the sleeve 7 inside the drilling 13. This results in the user being able to wear the bracelet watch of the invention securely on his/her wrist. The circumferential groove 11 interacts with the ball 16 in order to permit a free rotation of the sleeve 7 in the drilling 13.

In order to dismantle the bracelet 2 from the case 1 of the watch, it suffices to impose a force along the sleeve 7, which is sufficiently large to release the ball 16 from the circumferential groove 11 of the sleeve 7.

Preferably, the sleeve 7 and the elastic tubular blade 6 are made from metallic material in order to improve the mechanical performance of the rigid element 2a. The closed end 10 of the sleeve 7 preferable consists of the same metal as that on the corresponding lateral side of the case 1 of the watch, so as to form a uniform surface on the said side of the case when the metallic element 2a is in the assembled position relative to the corresponding side 1a of the case. Generally, the visible external surface of the case 1 of the watch is advantageously made from a precious metal, such as gold.

The present invention makes it possible to produce the sleeve 7 and the tubular blade 6 in a less precious metal having superior mechanical properties, for example from stainless steel, which also permits a reduction in the manufacturing cost. The closed end 10 of the sleeve 7 may comprise a layer of plated gold.

The structure of the metallic element 2a, 2b is quick and simple to fit on the end parts of the bracelet 2, which may be of varied length, thickness, color and appearance.

Figure 5:
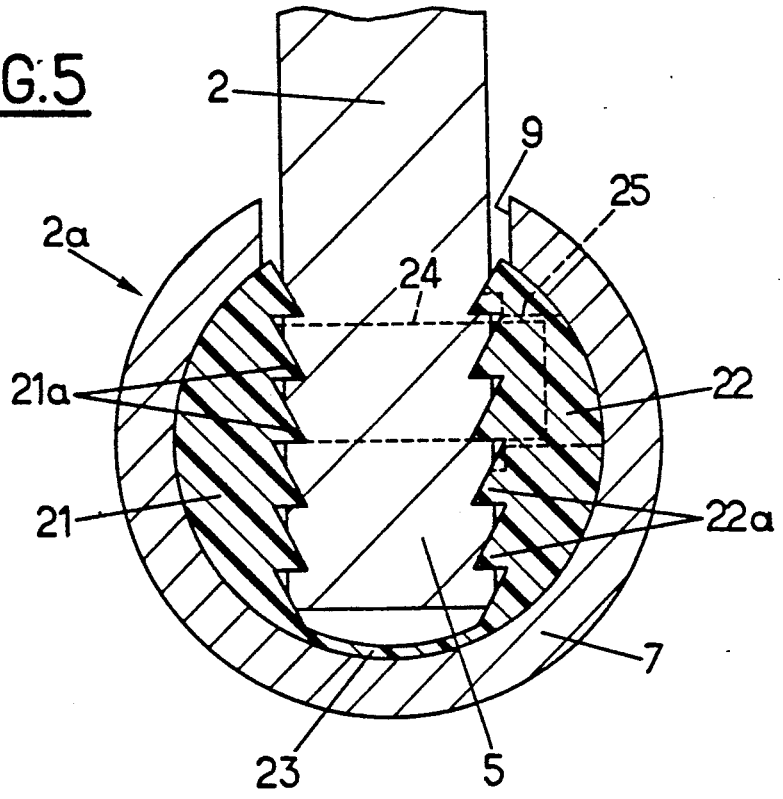
FIG. 5 is a radial sectional view of the rigid element along the bracelet in order to show the structure of the rigid element according to the second embodiment of the invention.
Figure 6:
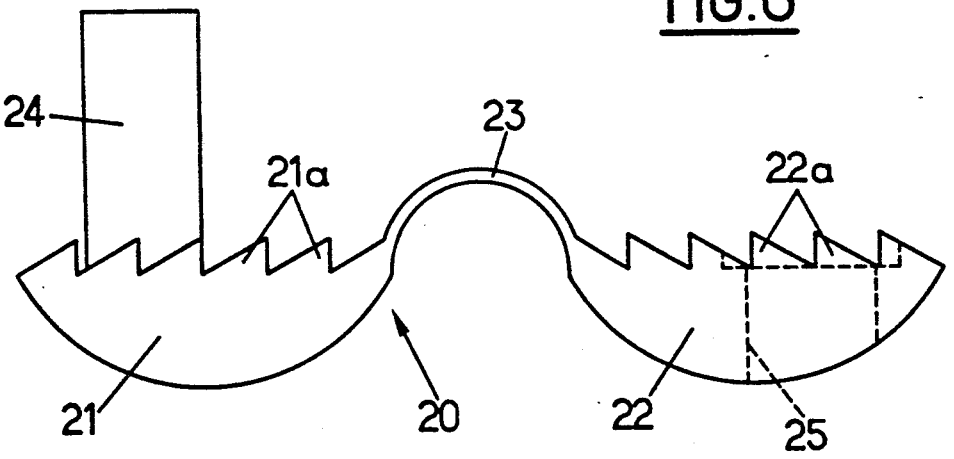
FIG. 6 is a side view of the jaw in the open position according to the second embodiment of the invention.

The second embodiment of the invention, illustrated in FIGS. 5 and 6, differs from the first embodiment described above only in that the elastic tubular blade 6 is replaced by a cylindrical jaw 20 in the rigid element 2a.

The jaw 20 comprises two toothed elements 21, 22 connected to each other by means of a longitudinal flexible tab 23. In the assembled position of the bracelet 2 in the rigid element 2a, the free end part 5 of the bracelet 2 is sandwiched between the teeth 21a and 22a of the toothed elements 21 and 22 of the jaw 20. The teeth 21a and 22a penetrate into the opposite faces of the free end part 5 of the bracelet 2 in order to hold it in position.

The jaw 20 thus closed is then inserted axially into the sleeve 7, allowing the bracelet to slide in the longitudinal slot 9 of the sleeve 7. The elasticity of the bracelet 2 tends to separate the toothed elements 21 and 22 of the jaw 20, pressing them against the inner wall of the sleeve 7 which then holds the jaw in the same manner as for the elastic blade 6.

In order to improve the holding of the bracelet in the rigid element 2a, the jaw 20 may have at least one stud 24 on the toothed face of the toothed element 21 and at least one receiving hole 25 for the stud 24 made in the other toothed element 22. As a result, the free end part 5 of the bracelet must have perforations which correspond in number to those of the stud 24/receiving hole 25 pairs of the jaw 20.

In this manner, on closing of the jaw 20 on the free end 5 of the bracelet 2, the stud or studs 24 passes or pass through the perforation or perforations of the free end 5 and penetrates or penetrate into the corresponding receiving hole or holes 25 and is or are locked therein. Holding of the bracelet 2 by the rigid element 2a is thus improved. In practice, two studs 24 are used in the jaw 20.

The jaw 20 is preferably made in a single piece. It must have good mechanical strength to carry out its function. To this end, it may be produced from metallic material or from rigid plastic material. The jaw 20 may, for example, be made in one piece from molded plastic material.

I claim:

1. Bracelet watch comprising a watch having a case (1) with at least two parallel opposite sides (1a, 1b) each provided with assembly means removably fitting into a rigid element (2a, 2b) reinforcing a free end (5) of a flexible bracelet (2), the assembly means of the case of the watch comprising a drilling (13) whose wall has an axial slot (14) passing through it of a width greater than the thickness of the bracelet, characterized in that the rigid element comprises an elastic tubular blade (6) and a sleeve (7), one end (10) of which is closed, the tubular blade having a toother axial slot (8) in which the free end (5) of the flexible bracelet is inserted, the sleeve having an axial slot (9) emerging at the open end of the sleeve and the opening of which is larger than the thickness of the bracelet, the external diameter of the sleeve being substantially identical to that of the one of the drillings (13) of the case, the internal diameter of the sleeve being smaller than the external diameter of the tubular blade, such that the axial insertion of the tubular blade into the sleeve requires an elastic deformation of the blade, giving rise to blocking of the free end of the bracelet by pinching of the toothed slot.

2. Bracelet watch comprising a watch having a case (1) with at least two parallel opposite sides (1*a*, 1*b*) each provided with assembly means removably fitting into a rigid element (2*a*, 2*b*) reinforcing a free end (5) of a flexible bracelet (2), the assembly means of the case of the watch comprising a drilling (13) whose wall has an axial slot (14) passing through it of a width greater than the thickness of the bracelet, characterized in that the rigid element comprises a cylindrical jaw (20) and a sleeve (7), one end of which is closed, the jaw comprising two toothed elements (21, 22) joined to each other by means of a longitudinal flexible tab (23) and sandwiching the free end (5) of the bracelet with the aid of teeth (21*a*, 22*a*), the sleeve having an external diameter substantially identical to that of one of the drillings (13) of the case and having an axial slot (9) emerging at the open end of the sleeve and the opening of which is larger than the thickness of the bracelet, the jaw being inserted axially inside the sleeve via its open end and held in the sleeve by the elastic deformation of the free end of the bracelet.

3. Bracelet watch according to claim 2, characterized in that one of the toother elements (21) has, on the toothed face, at least one stud (24), and in that the other toothed element (22) has at least one receiving hole (25) for the stud, the free end (5) of the bracelet comprising at least one perforation so that, when the jaw (20) is closed, the stud passes through the perforation and penetrates into the receiving hole in order to be blocked therein.

4. Bracelet watch according to claim 2, characterized in that the jaw is made in a single piece from metallic material.

5. Bracelet watch according to claim 2, characterized in that the jaw is made in a single piece molded from plastic material.

6. Bracelet watch according to claim 1, characterized in that the elastic tubular blade (6) is made from metallic material.

7. Bracelet watch according to claim 1, characterized in that it comprises a pawl means consisting, on the one hand, of a circumferential groove (11) on the outer face of the sleeve (7) and, on the other hand, of a retractable protuberance (16) interacting with a compression spring (18) inside a cavity (17) made on the inner wall of the drilling (13).

8. Bracelet watch according to claim 1, characterized in that the respective openings of the two drillings of the case (1) are located diametrically opposite each other.

9. Bracelet watch according to claim 1, characterized in that the sleeve (7) is made from a metallic material.

10. Bracelet watch according to claim 1, characterized in that the rigid elements (2*a*, 2*b*) are made at least partially with the aid of a metallic material other than that forming the outer face of the case (1).

* * * * *